US005356233A

United States Patent [19]

Blenkush et al.

[11] Patent Number: 5,356,233

[45] Date of Patent: Oct. 18, 1994

[54] MECHANICAL-ELECTRICAL SAFETY LOCKING SYSTEM

[75] Inventors: William M. Blenkush, Elk River; Harry R. Brown, Buffalo; Michael A. Knipfer; Wade D. Palashewski, both of Maple Grove, all of Minn.

[73] Assignee: Honeywell, Inc., Minneapolis, Minn.

[21] Appl. No.: 993,347

[22] Filed: Dec. 18, 1992

[51] Int. Cl.[5] ..... H01R 13/453

[52] U.S. Cl. ..... 403/4; 439/138

[58] Field of Search ..... 439/135, 136, 137, 138; 403/4, 80

[56] References Cited

U.S. PATENT DOCUMENTS

| | | | |
|---|---|---|---|
| Re. 32,340 | 1/1987 | Dobson et al. | 439/138 X |
| 2,288,241 | 6/1942 | Holcomb | 439/136 X |
| 3,276,241 | 10/1966 | Hübner | 439/138 X |
| 5,135,406 | 8/1992 | Ishikawa | 439/136 X |
| 5,199,888 | 4/1993 | Condra et al. | 439/136 X |

FOREIGN PATENT DOCUMENTS

| | | | |
|---|---|---|---|
| 1590105 | 6/1970 | Fed. Rep. of Germany | 439/135 |
| 2229543 | 2/1973 | Fed. Rep. of Germany | 439/138 |
| 2506676 | 9/1975 | Fed. Rep. of Germany | 439/135 |

*Primary Examiner*—Randolph A. Reese
*Assistant Examiner*—Christopher J. Novosad
*Attorney, Agent, or Firm*—Charles J. Ungemach

[57] ABSTRACT

The present invention relates to electronic chassis installed on aircraft. More particularly, the present invention relates to a safety locking system for establishing the presence of the mechanical-electrical integrity of a chassis. More specifically, disclosed is a safety locking system for conditionally permitting or disallowing mating of an external connector with a mating chassis connector dependent upon whether or not the chassis is fastened to a support frame.

7 Claims, 4 Drawing Sheets

MECHANICAL-ELECTRICAL SAFETY LOCKING SYSTEM

The present invention relates to electronic chassis installed on aircraft. More particularly, the present invention relates to a safety locking system for establishing the presence of the mechanical-electrical integrity of a chassis. More specifically, disclosed is a safety locking system for conditionally permitting or disallowing mating of an external connector with a mating chassis connector dependent upon whether or not the chassis is fastened to a support frame.

BACKGROUND OF THE INVENTION

Electronic systems are commonly employed in both land vehicles and aircraft, as well as marine vehicles, all of which are herein referred to as simply vehicles. These electronic systems are generally packaged into one or more chassis, each chassis being rigidly mounted to a support frame or shelf which is rigidly attached to the vehicle. For more sophisticated systems, a plurality of electronic chassis are installed on the vehicle and are electrically accessed and/or interconnected through electrical cables having end connectors which are electrically connected to a mating chassis connector.

After such electronic systems are properly electrically connected, the systems may then be functionally tested. However, the functional testing provides no indication as to the reliability of the fastening of the electronic chassis to the support frame. If such chassis are not properly fastened to the support frame, the chassis may be dislodged from the support frame when the vehicle is subjected to any of a variety movements including rotation, translation, shock and vibration. In turn, such movements may have deleterious effects to the overall electronic systems due to electronics failure caused by the chassis being dislodged and/or the potential for disengagement of the mating connectors.

The importance of the integrity of the mating of the electrical connectors and the fastening of the chassis to the support frame is of paramount importance, particularly in aircraft. This is so because the aircraft is subjected to yaw, pitch and roll movements in flight, and severe shock and vibration, particularly during landings and take off. Movement of the chassis including the inertial sensors may disrupt the on-line navigation system caused by a change in the precise alignment of the inertial sensors relative to the support frame. Since safety requirements are extremely important for aircraft, both commercial and military, there is a long felt need for providing a system for enhancing the reliability of chassis installations in aircraft, as well as other vehicles.

SUMMARY OF INVENTION

An object of the present invention is to provide a reliable system for ensuring that electronic systems can only be tested if the electronic chassis are properly fastened to the vehicle support frame.

In the present invention, a moveable blocking member is utilized to disallow mating of an external connector with a mating chassis connector when the blocking member is in a blocking position, and permits the mating of the external connector with the mating chassis connector when the blocking member is in the non-blocking position. Further, the system in accordance with the invention includes a fastener for securing the chassis to the aircraft or vehicle support frame where the fastener includes a fastener member moveable between a first mechanical position which prevents the blocking member from obtaining the non-blocking position, and a second mechanical position which permits the blocking member to move to the non-blocking position.

Further, in accordance with the present invention, the chassis is prevented from being unfastened to the support frame unless the mated connectors are first removed.

A BRIEF DESCRIPTION OF THE DRAWINGS

FIG. 1 shows an isometric view of a chassis, including the chassis connectors and the safety system in accordance with the present invention.

FIGS. 2*a* and 2*b* show a front view and a side view, respectively, of a safety system in accordance with the present invention in the connector blocking position.

FIGS. 3*a* and 3*b* show a front view and a side view, respectively, of the safety system in accordance with the present invention in the connector non-blocking position.

FIG. 4 is an isometric drawing illustrating further details of the chassis fastening means assembly in accordance with the present invention.

DETAILED DESCRIPTION OF THE INVENTION

Figure 1:
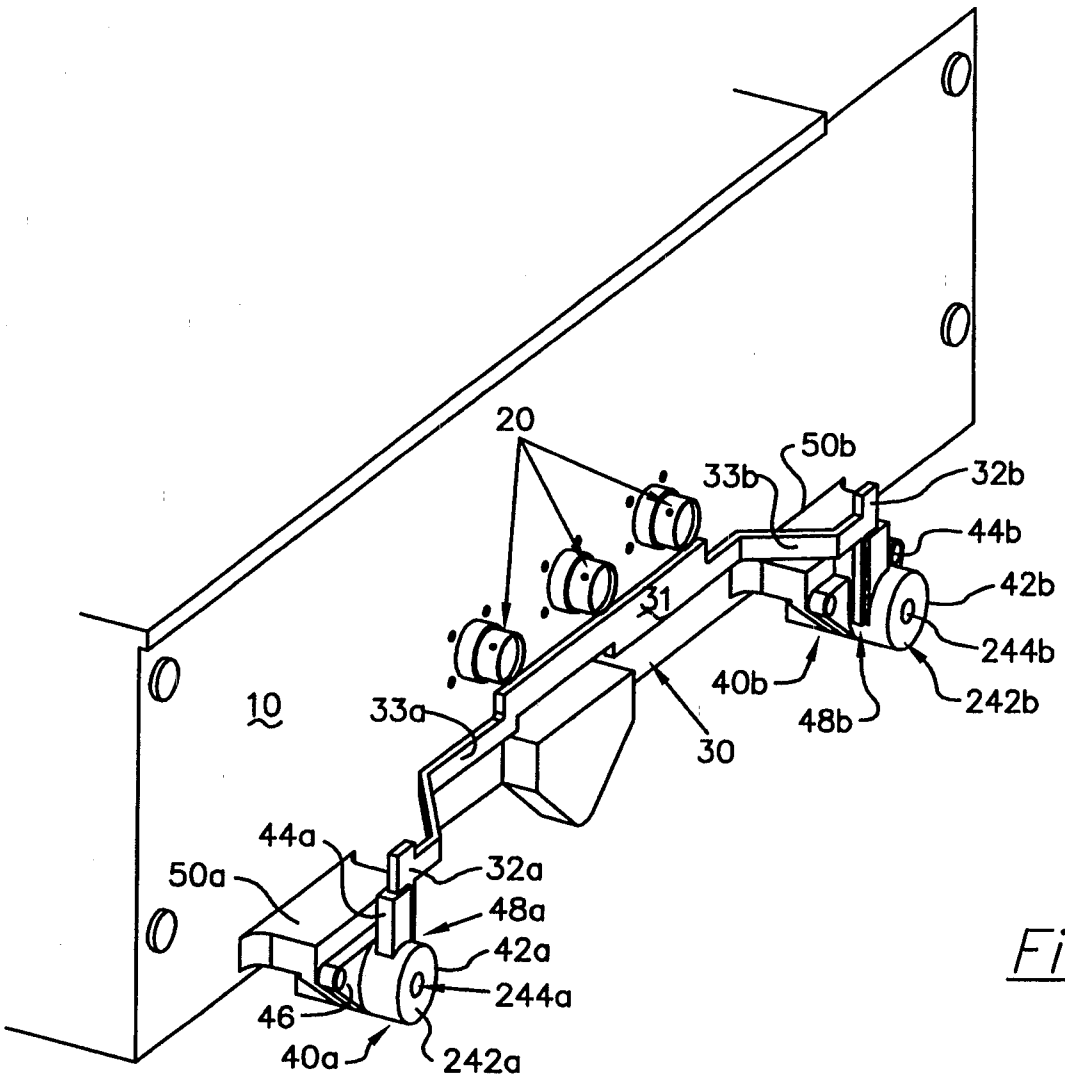

The mechanical-electrical safety locking system in accordance with the present invention is particularly illustrated in FIGS. 1, 2 and 3. FIG. 1 is an isometric drawing showing a typical chassis 10 having a plurality of chassis connectors 20. FIG. 1 illustrates connectors of the circular electrical receptacle type which are of box-mounted and bayonet coupling style. However, the connectors may also be any of a variety of connectors, including RS232, type D connectors and the like. Further illustrated in FIG. 1 is a blocking member generally illustrated as a bar 30 extending in a generally longitudinal direction. Bar 30 may be, for example, a stamped piece of aluminum having particular members and bends to serve intended functions as will be more particularly described.

Bar 30 includes a longitudinal blocking member 31 and rectangular shaped end members 32*a* and 32*b* extending in a direction transverse to the longitudinal direction of blocking member 31. End members 32*a* and 32*b* are connected by members 33*a* and 33*b* which provides an effective bend in bar 30 so as to provide an offset spacing between blocking member 31 and end member 32. As should be apparent to the reader from examination of the drawings, bar 30 is configured to conform to the specific structure of chassis 10, and all such configurations are within the spirit and scope of the present invention.

Mounted to chassis 10 are guide members numerically identified in FIG. 1 as 40*a* and 40*b*. The details of guide members 40*a* and 40*b* are particularly illustrated in FIGS. 2*a*, 2*b*, 3*a*, 3*b*, and 4. FIGS. 2*a*, 2*b*, 3*a* and 3*b* only show a partial drawing of FIG. 1, particularly illustrating the front view and side view of bar 30 and guide member 40*a*. The left-hand side being the mirror image of the right-hand side, therefore only the leftside shall be described. In the following exposition the "a" and "b" nomenclature shall be dropped.

Figure 2A:
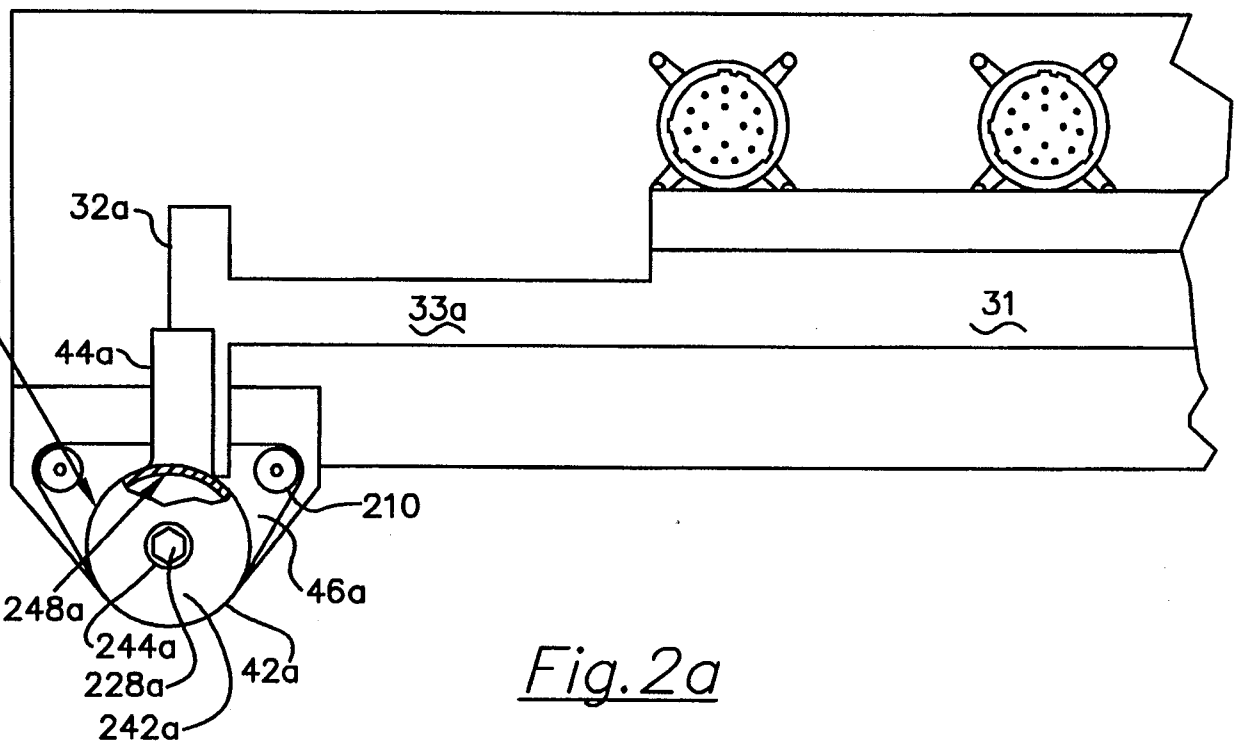
Figure 2B:
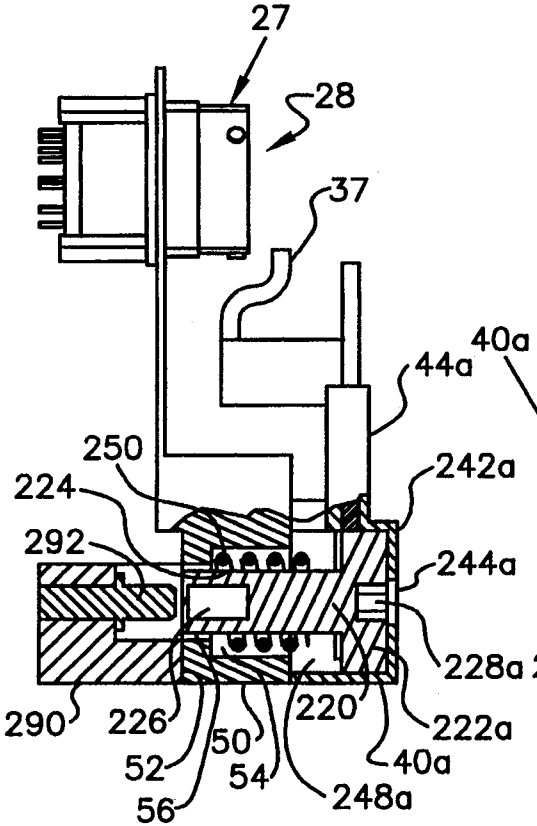
Figures 3A, 3B:
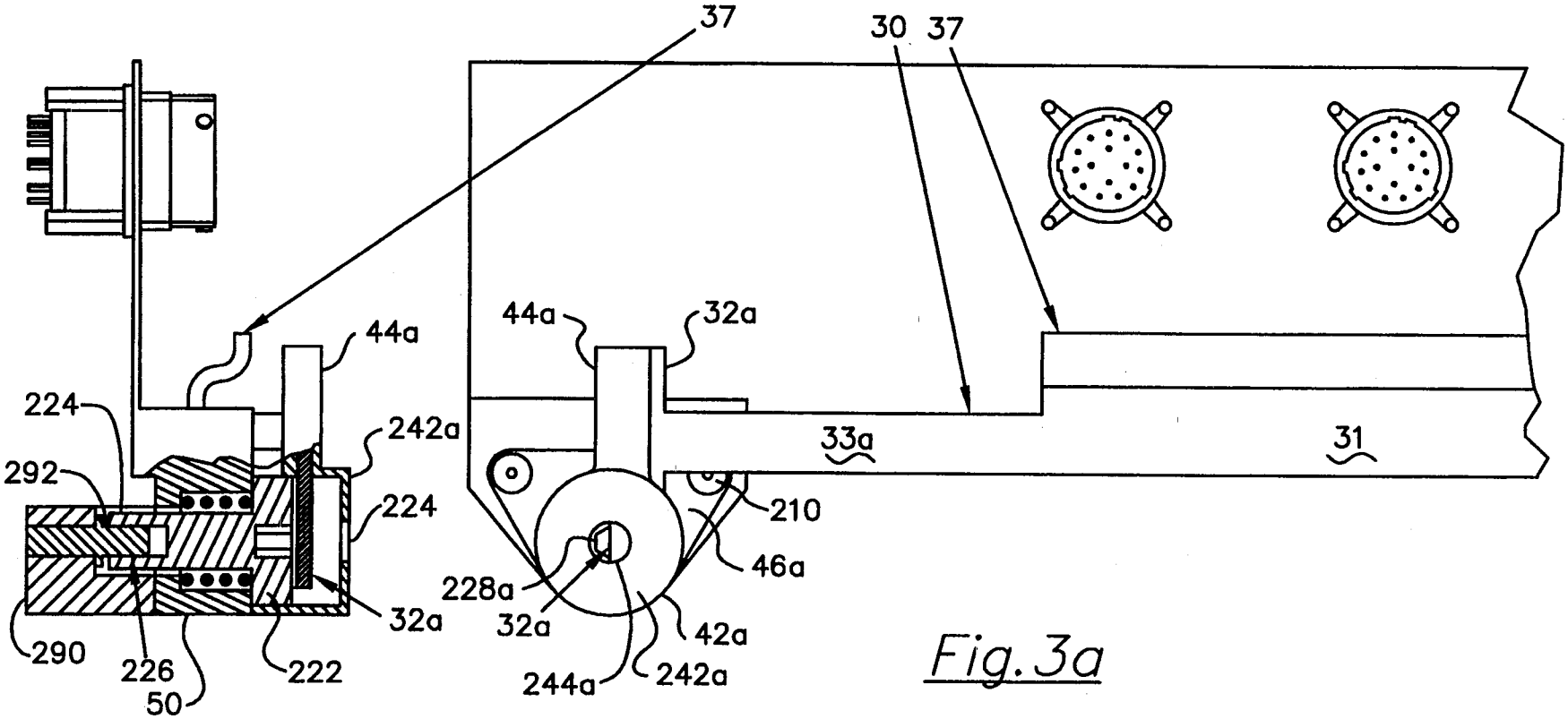
Figure 4:
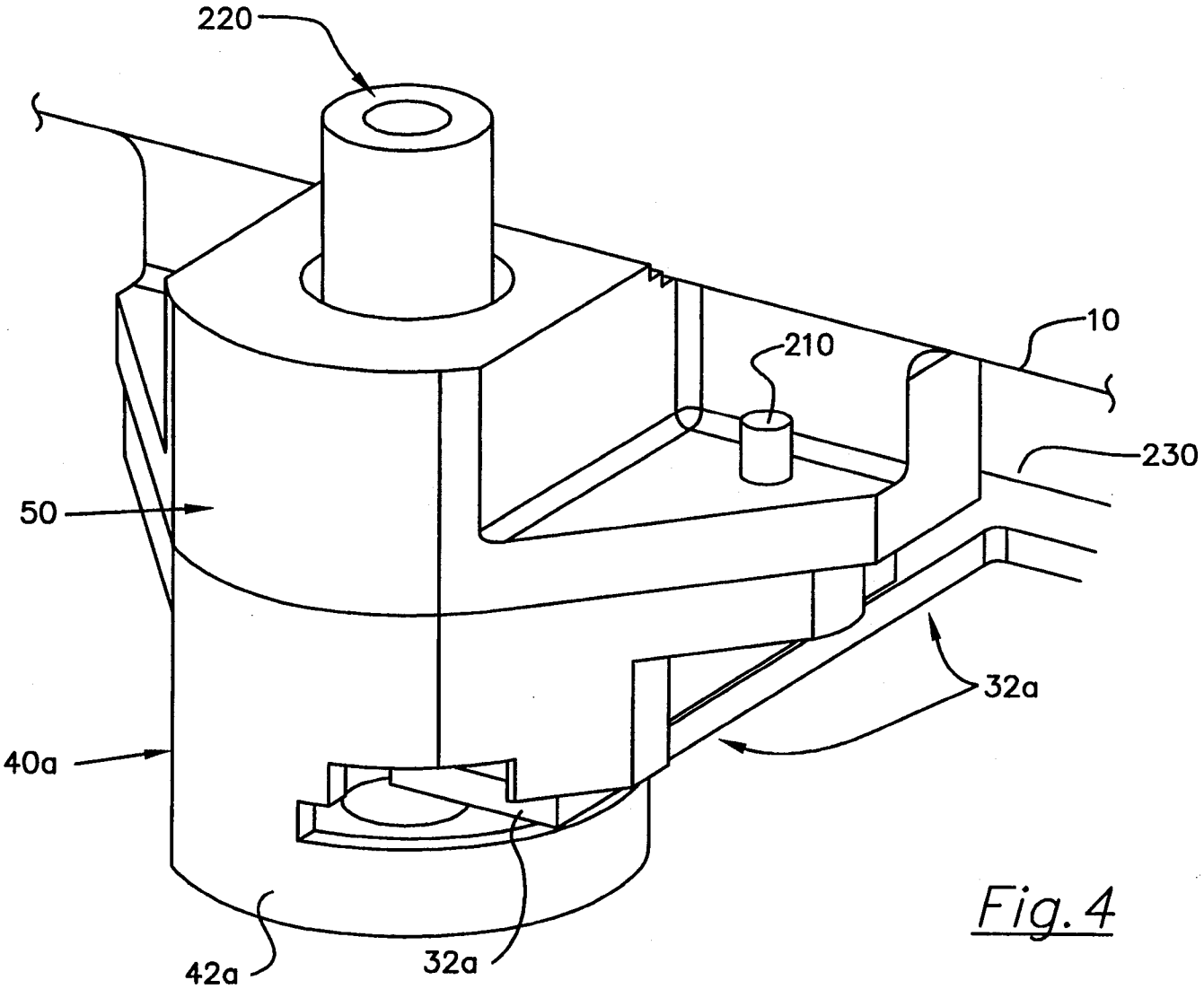

Now particularly referring to FIG. 2*a* and 2*b*, the details of guide member 40 will now be described.

Guide member 40 generally includes barrel shaped member 42, a channel member 44, and mounting flange 46. Barrel member 42 further includes a slot 48 which serves as an extension of channel guide member 44. Barrel member 42 also includes an end member 242 thereby forming an open-ended cavity 248. End member 242 further includes an aperture 244 serving as access hole in a manner as will be described.

The channel guide member 40 and locking bar 30 are configure to provide a cooperative relationship which will more particularly described below. However, more specifically, channel member 44 and slot 48 are sufficiently sized to permit end member 32 of bar 30 to slide within the channel provided by channel member 32 and slot 48. As illustrated by the Figures, bar 30 is allowed to slide up and down as guided by guide members 40. As will be more fully described, longitudinal blocking member 31 of bar 30 is able to slide between a connector blocking position, upward as illustrated in FIGS. 1, *2a* and *2b*, and a connector non-blocking position, downward as illustrated in FIGS. *3a* and *3b*.

Again referring to the Figures, chassis 10 includes lugs 50 having an end member 52 which forms, in part, a cavity 54. End member 52 includes an aperture 56 for passing a bolt stem 224 of bolt 220 therethrough. Lug 50 further includes threaded apertures (not shown) for receiving bolts 210 for mounting guide member 40. Each guide member 40 is mounted to chassis lug 50 by way of bolts 210 passing through flange member 46, in part, and threaded into the threaded aperture of chassis lugs 50. Alternatively, and preferably, guide member 40 is riveted or welded to lug 50 to prevent disassembly of safety locking system in accordance with the present invention.

Referring now particularly to FIG. *2b*, guide member 40 and lug 50 are configured to form a housing or cavity to retain bolt 220 and compression spring 250 in manner as will now be described.

In combination, with guide member 40 mounted to lug 50, a bolt 220 and a compression spring 250 are retained within the cavity formed by cavities 248 and 54 of guide member 40 and lug 50, respectively, with bolt 220 passing through spring 250, in part. Bolt 220 includes a head portion 222 and a step 224 including a threaded aperture 226 at the end thereof. Bolt 220 and spring 250 are selected such that the stem 224 of bolt 220 passes through compression spring 250. Thus, guide member 40 and lug 50 are configured so as to house and constrain movement of spring 250 and bolt 220, particularly the longitudinal movement of bolt 220 within the cavity so formed.

Also illustrated in FIGS. *2b* and *3b* is a portion of a support frame 290 including a threaded stud 292. Threaded stud 292 and internally threaded bolt 220 are selected such that bolt 220 may be tightened upon threaded stud 292 in the usual manner.

Bolt 220 further includes a feature 228 as part of bolt head 222, illustrated as a hexagon-shaped aperture, so that bolt 220 may be turned with a mating tool (not shown) to fasten bolt 220 upon the threaded stud 292 of support frame 290. Access to feature 228 is provided by aperture 244 in end member 242 of guide member 40.

The operation of the mechanical-electrical safety locking system of the present invention will now be described. FIG. *2a* illustrates bar 30 in a connector blocking position. That is, bar 30, and more specifically blocking member 31 is of sufficient structure to disallow mating of an external mating connector (not shown) to chassis connectors 20, i.e., the connector blocking position. As particularly illustrated in the drawing, the upper portion of blocking member includes a lip like structure 37 such that travel of bar 30 in upward direction is restricted by the chassis connector box-like housing 27 and concurrently blocks access to the front 28 of connector 20, at least in part.

As particularly illustrated in FIG. *2b*, when bolt 220 is in the "unfastened" position, spring 250 is in a relaxed condition. The aforesaid cavity formed by lug 50 and guide member 40 in combination with bolt 220 is such that bolt head 224 blocks end member 32 of bar 30 from sliding downward, i.e., down into slot 48 of barrel 42. However, when bolt 220 is tightened into stud 92, bolt 220 will effectively translate to a new position, i.e. the fastened position. Accordingly, the arrangement of guide member 40 is such that bolt head 224 no longer blocks end member 32 of bar 30 from sliding downward, and permits end member 32 to slide into slot 48 of barrel 42. In this situation, bar 30 is permitted to slide downward to the connector non-blocking condition, as particularly illustrated in FIGS. *3a* and *3b*.

Referring now particularly to FIGS. *2a* and *2b*, with bar 30 in the upward position, a tool (not shown) may be permitted to pass through aperture 244 to access the hexagon aperture 228 of bolt 220, thereby permitting bolt 220 to be turned and threaded onto stud 292 of support frame 290. Spring 250 accentuates the torque required to turn bolt 220. Spring 250 is selected such that bolt 220 may only be turned by a tool adequate to turn the bolt and overcome the force applied to the bolt head 222 by spring 250. Once the tool engages with the bolt feature 228, the tool may be utilized to complete movement of bolt 220 to a fastened position which thereby allows slide member 32 to be slid downward to the position as particularly illustrated in FIGS. *3a* and *3b*.

Once the bolt is threaded onto stud 290, and the tool has been removed, end member 32 may be slid downward into slot 48 and results in bar 30 being in a connector non-blocking position which permits access to connectors 20, i.e., the connector front 28 is no longer blocked, and subsequent connection to the external connector (not shown) may be completed. Channel member 44 and end member 32 are configured so that end member 32 may slide downward and a portion thereof blocks access to the bolt feature 228 through access aperture 244 as illustrated.

In summary, bolt 220 may move between the unfastened and fastened positions. The unfastened position of bolt 220 is such that the spring 250 is in the relaxed condition and bolt head 220 blocks end member 32 from sliding downward, thereby maintaining bar 30 in the connector blocking position (FIGS. *2a* and *2b*).

When bolt 220 moves to the fastened position, corresponding to the situation where bolt 220 is threaded onto stud 292 and no longer blocks travel of end member 32, and the tool removed, bar 30 is permitted to move downward by virtue of end member 32 sliding downward, corresponding to the non-blocking position of bar 30. In turn, the external connectors may then be permitted to engage with the mating chassis connectors. In theses circumstances, end member 32 is in a position which partially blocks access to bolt feature 228 through aperture 244 which thereby prevents bolt 220 from being turned to unfastened the chassis from the support frame.

It should be recognized that if the external connector is mated with the chassis connector, bar 30 may not be slid upward to the blocking position and unblocking access to feature 228 through aperture 244. This prevents chassis 10 from being unfastened, with a tool, from the support frame 290. Accordingly, the electrical connectors 20, as aforesaid must be first disengaged to permit bar 30 to move upward, as illustrated in the drawing, whereby slide member 32 is also in the upward position to unblock the access aperture 244 to permit bolt 220 to be disengaged from stud 292 with a tool.

In other words, the safety mechanical-electrical locking system of the present invention is such that mating electrical connectors cannot be engaged with the chassis connectors unless the fastening member, namely bolt 220, is properly engaged with the stud 292 of support frame 290. Only after the bolt 220 has been properly threaded onto stud 292, i.e., the chassis fastened to the support frame, may the locking bar 30 be moved to the non-blocking position. When locking bar 30 is in the non-blocking position, again, mating of electrical connectors 20 is permitted. However, when blocking member 30 is in the non-blocking position, the fastening member, bolt 220, is not permitted to be disengaged unless the locking bar is raised to the upward position. However, this may only occur at such times as the electrical connectors 20 are no longer engaged. Thus, when the electronic systems are functionally tested, there exists a high reliability that the electronic chassis have, in fact, been properly fastened to the support frame. Further, once the functional testing has taken place, the electronic chassis may not be disengaged without first disengaging the electrical connectors from the chassis. Doing so, would cause the electronic systems to fail with presumably an indication somewhere in the system's electronics that there is a system failure. Thus, the safety locking system of the present invention provides a highly reliable indication that the electronic chassis has been properly fastened to the support frame when the electronic system is checked out functionally. This is particularly required in fault tolerant aircraft systems where data integrity of the inertial sensor assembly chassis is of paramount importance.

Although the present invention has been described with reference to the preferred embodiments, workers skilled in the art will recognize that changes may be made in form and detail without departing from the true spirit and scope of the present invention.

More specifically, although the fastener or fastening member has been illustrated as a particular bolt-stud combination, other fastening techniques are within the scope of the present invention. Further, although in the preferred embodiment a locking bar has been illustrated, other structures including disc-shaped structures are of course possible. That is a disc-shaped blocking member may be utilized to provide the function as described in the present specification. Lastly, although the present invention may be advantageously applied to electronic chassis, other such installations are within the scope and meaning of the word chassis, e.g., chassis including pneumatic and optical controls housed in a chassis where the connectors are pneumatic or optical, respectively, as opposed to electrical type connections.

Although particular structures have been suggested by way of example as illustrated in the drawings, there exist a wide variety of assembly techniques for providing the intended function in accordance with present invention.

The embodiments of an invention in which an exclusive property or right is claimed are defined as follows:

1. An apparatus for conditionally permitting or preventing the mating of a first connector with a mating chassis connector dependent upon the fastening of the chassis, having said mating chassis connector secured thereto, to support frame, the apparatus comprising:

a blocking member moveable between (i) a blocking position preventing said first connector from mating with said chassis connector, and (ii) a non-blocking position permitting said first connector to mate with said chassis connector;

a bolt having a head, apart from said first connector and said chassis connector, for securing said chassis to said support frame, said bolt being in operative relationship with said blocking member with said bolt being moveable between (i) an unfastened position where said chassis is not fastened to said support frame and said bolt prevents said blocking member from attaining said non-blocking position, and (ii) a fastened position where said chassis is fastened to said support frame and said blocking member is permitted to attain said non-blocking position;

a compression type spring for exerting a force on said bolt in a manner so as to urge said bolt toward said unfastened position; and housing means for constraining said bolt and said compression spring and permits said bolt to translate, upon compression of said compression spring, a channel means; and a slideable member coupled to said blocking member, and configured to slide along said channel means, at least in part, between first and second slide positions concurrently with said blocking position and said non-blocking position of said blocking member.

2. The apparatus of claim 1 wherein said bolt translates perpendicular to said channel means such that said slideable member is prevented from reaching said second slide position with said bolt in the unfastened position, and said slideable member is permitted to slide to said second position with said bolt in the fastened position.

3. The apparatus of claim 1 wherein said bolt head includes a feature by which said bolt may be turned with a tool, and said housing means further including an aperture for accessing said bolt head feature with a tool with said slideable member in said first slide position, and access to said bolt head feature by said tool is blocked in part by said slideable member with said slideable member in said second position.

4. An apparatus for conditionally permitting or preventing the mating of a first connector with a mating chassis connector dependent upon the fastening of the chassis, having said mating chassis connector secured thereto, to a support frame, the apparatus comprising:

a blocking member moveable between (i) a blocking position preventing said first connector from mating with said chassis connector, and (ii) a non-blocking position permitting said first connector to mate with said chassis connector;

a bolt, apart from said first connector and said chassis connector for securing said chassis to said support frame;

housing means secured to said chassis for constraining said bolt and a compression spring, where said compression spring is operative for permitting said bolt to translate, upon compression of said compression spring, said housing further including a channel therein;

a slideable member coupled to said blocking member, and configured to slide along said channel, at least in part, between first and second slide positions concurrently with said blocking position and said non-blocking position of said blocking member; and said bolt being in operative relationship with said blocking member with said bolt being moveable between (i) an unfastened position where said chassis is not fastened to said support frame and said fastening member prevents said blocking member from attaining said non-blocking position, and (ii) a fastened position where said chassis is fastened to said support frame and said blocking member is permitted to attain said non-blocking position.

5. The apparatus of claim 4 wherein said operative relationship of said bolt and said blocking member is such that said bolt may only be moveable to said unfastened position from said fastened position with said chassis connector not being mated with said first connector.

6. The apparatus of claim 4 wherein said bolt translates perpendicular to said channel such that said slideable member is prevented front reaching said second slide position with said bolt in the unfastened position, and said slideable member is permitted to slide to said second position with said bolt in the fastened position.

7. The apparatus of claim 4 wherein said bolt includes a feature by which said bolt may be turned with a tool, and said housing means further including an aperture for accessing said bolt with a tool with said slideable member in said first slide position, and access to said bolt by said tool is blocked in part by said slideable member with said slideable member in said second position.

* * * * *